United States Patent [19]

Gernhardt et al.

[11] 4,159,447

[45] Jun. 26, 1979

[54] SYSTEM FOR DETECTING FAULTS IN THE WALL OF A HIGH-TEMPERATURE PRESSURE VESSEL

[75] Inventors: Paul Gernhardt, Bochum; Wolfgang Grams, Herne; Wilhelm Dänguillier; Siegfried Pohl, both of Bochum, all of Fed. Rep. of Germany

[73] Assignees: Dr. C. Otto & Comp. G.m.b.H., Bochum; Saabergwerke, A.G., Saarbrucken, both of Fed. Rep. of Germany

[21] Appl. No.: 835,945

[22] Filed: Sep. 22, 1977

[30] Foreign Application Priority Data

Sep. 25, 1976 [DE] Fed. Rep. of Germany ..... 2643310

[51] Int. Cl.[2] ..... G01R 31/02; G01K 11/06; B01J 3/00

[52] U.S. Cl. ..... 324/51; 48/87; 73/358; 340/590

[58] Field of Search ..... 324/51, 52, 54, 65 R; 340/227 R, 227 C, 256, 590, 596, 605, 595; 73/349, 358; 48/62 R, 87, DIG. 2

[56] References Cited

U.S. PATENT DOCUMENTS

| | | | |
|---|---|---|---|
| 2,686,909 | 8/1954 | Poulson | 340/256 X |
| 2,691,698 | 10/1954 | Schmidt | 340/256 UX |
| 2,990,542 | 6/1961 | Seitz | 324/51 X |
| 3,406,384 | 10/1968 | Hartman et al. | 340/227 R |
| 3,418,207 | 12/1968 | Becker et al. | 324/52 X |
| 3,509,942 | 5/1970 | Lindberg | 340/256 X |
| 3,588,689 | 6/1971 | Crawford | 324/52 |
| 3,721,898 | 3/1973 | Dragoumis et al. | 324/65 R |
| 4,013,427 | 3/1977 | Gernhardt et al. | 48/62 R |

*Primary Examiner*—Gerard R. Strecker

*Attorney, Agent, or Firm*—Thomas H. Murray; Clifford A. Poff

[57] ABSTRACT

A system for detecting faults in the wall of a high-temperature pressure vessel, such as a fuel gasifier. The wall comprises an outer metallic shell having an inner refractory lining, together with cooling tubes extending along the refractory lining. In order to detect a fault, such as a rupture in a cooling tube and resultant melting of the refractory in the vicinity of the fault, one or more electrical conductors are embedded in the refractory and connected at their opposite ends to an external energizing circuit such that when the refractory melts, so also will the conductor, thereby breaking the circuit to indicate the existence of the fault.

5 Claims, 3 Drawing Figures

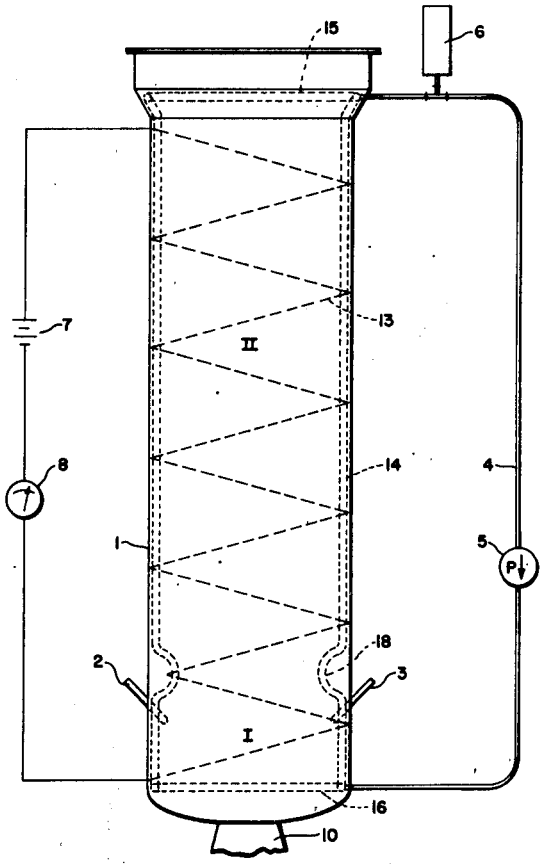

SYSTEM FOR DETECTING FAULTS IN THE WALL OF A HIGH-TEMPERATURE PRESSURE VESSEL

BACKGROUND OF THE INVENTION

Figure 1:
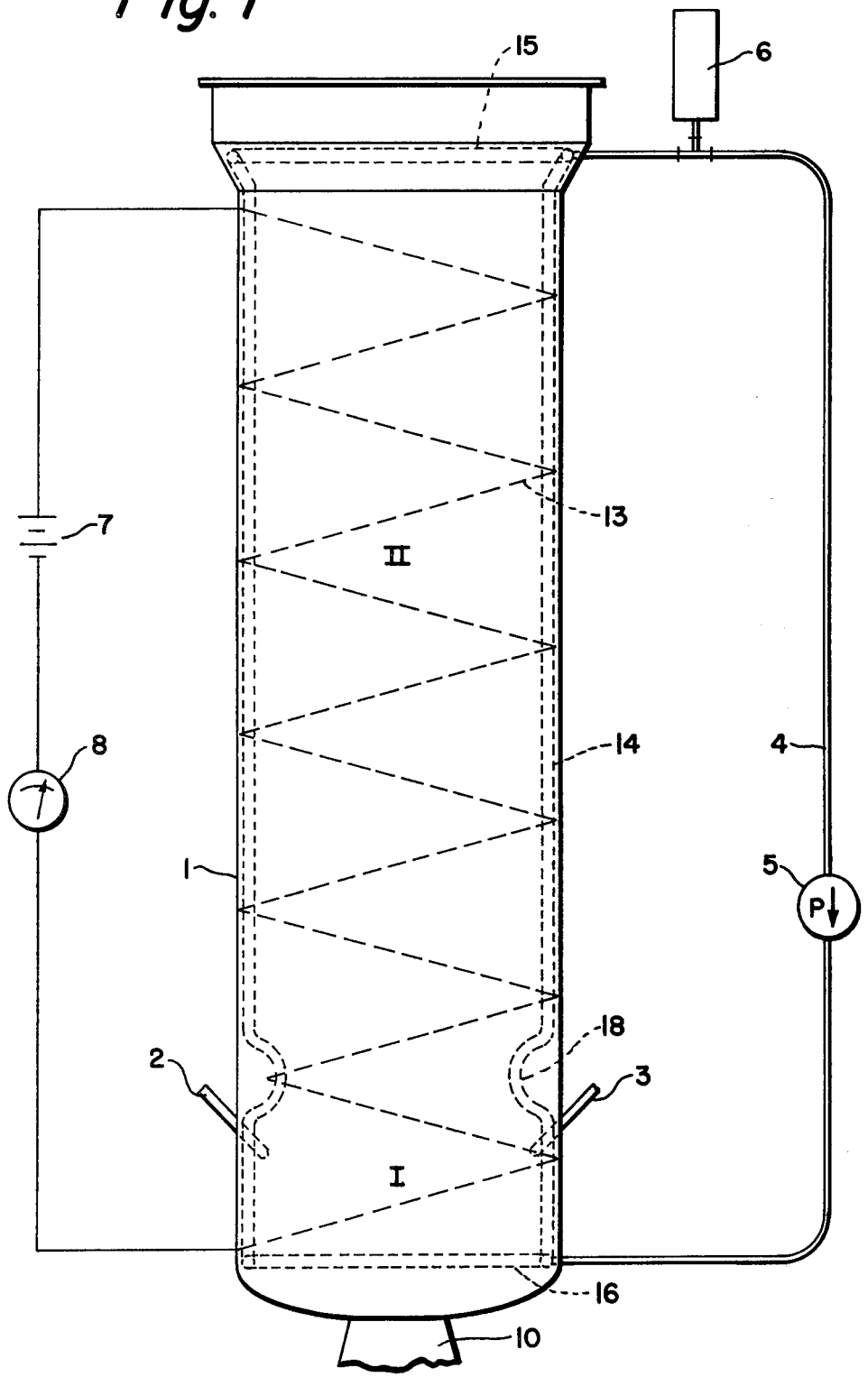

While not limited thereto, the present invention is particularly adapted for high-temperature pressurized gasifiers for coal or other carbonaceous material. Such gasifiers usually comprise a cylindrical pressure vessel in which coal fines and gasifying agents (e.g., oxygen and steam) are reacted by partial oxidation into mainly 2 or 3 atom gases such as CO, $H_2$, $CO_2$ and $H_2O$. One such gasifier of this type is the slag bath generator in which the feed materials are injected through a number of nozzles onto a slag bath which covers the bottom of the pressure vessel and consists of the melted mineral constituents of the fuel supplied. Gasification proceeds at very high temperatures of from 1500° C. to 2000° C. and at pressures around 25 bar.

The pressurized metal casing, which is usually cylindrical in configuration, is protected from the high temperature of the combustion chamber by groups of tubes in the form of rafts of tubes, for instance, through which a coolant flows, the tubes providing vapor cooling or hydraulic cooling with condensation of steam. Groups of cooling tubes of this type experience severe mechanical stressing, even in normal operation, due to the high heat flow densities involved. Furthermore, faults in the tubing may lead to local overheating of the tube group and, hence, to its destruction. For instance, the nozzle flames within the combustion chamber may accidentally be deflected directly onto the tube group, resulting in local overheating and impairment of the strength of the material from which the tubes are formed, in which event the entire tube group or one of its tubes may rupture.

A layer of ceramic heat insulating material a few centimeters thick is normally provided between the cooling tubes and the vessel wall to protect the same against direct heat radiation. If the cooling system develops a fault, such as a rupture in a tube, the ceramic layer will eventually melt and expose the outer cylindrical metal casing to heat from the gas or flame, thereby creating a dangerous condition. This sequence of events may occur unknown to anyone since the combustion chamber is not visually accessible, with the result that in the last resort the pressure vessel itself is placed at risk.

SUMMARY OF THE INVENTION

In accordance with the present invention, a system is provided for detecting faults in the wall of a high-temperature pressure vessel wherein checks are made continually or at frequent intervals of time to indicate any damage to the interior cooling tubes for the vessel quickly enough for the gasification process within the vessel to be stopped safely and repairs made.

Specifically, there is provided, in a high-temperature pressure vessel of the type in which cooling tubes extend around a combustion chamber disposed within a metal casing, the improvement of means for detecting a fault in a cooling tube and resultant localized heating, comprising at least one electrical conductor adjacent the cooling tubes on the side thereof opposite the combustion chamber. Means are provided external to the vessel for causing current to flow through the conductor, and further means are provided for detecting an interruption in current flow through the conductor to thereby indicate the existence of a fault in a tube and resultant heating and melting of the conductor. In the usual case, the electrical conductor or conductors are embedded within a refractory lining between the cooling tubes and the outer metal casing of the pressure vessel.

Figure 2:
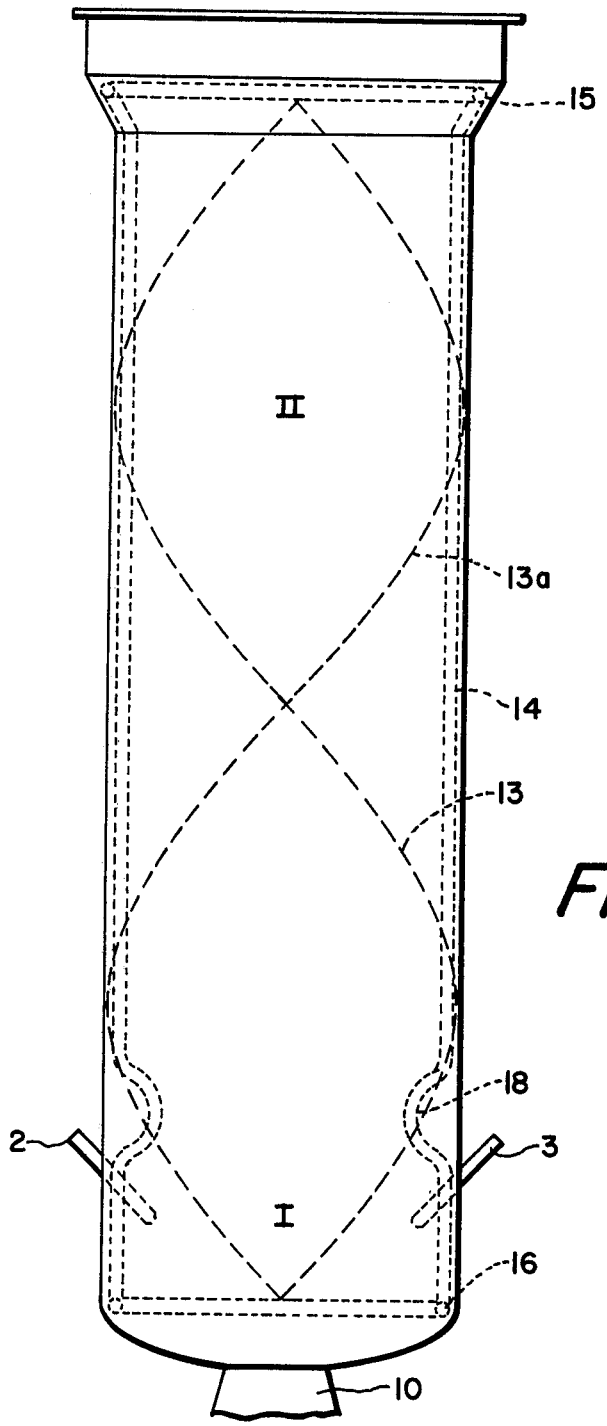
Figure 3:
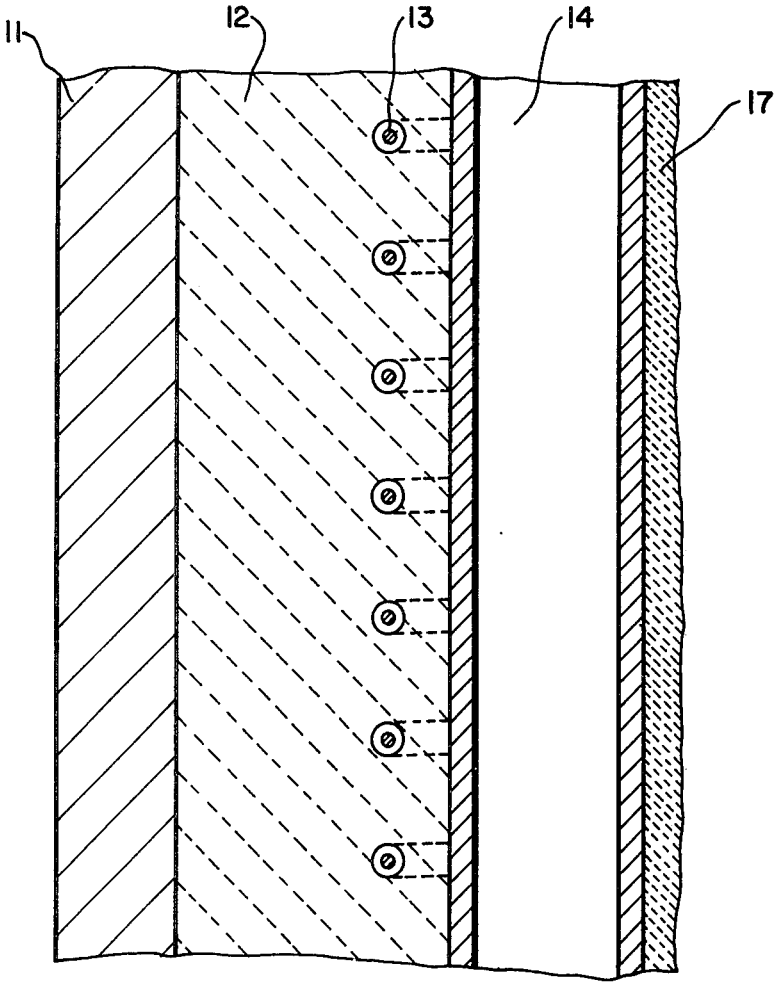

The above and other objects and features of the invention will become apparent from the following detailed description taken in connection with the accompanying drawings which form a part of this specification, and in which:

FIG. 1 schematically illustrates a slag bath generator incorporating the fault-detecting means of the invention in the form of a conductor helically wound around a group or basket of cooling tubes, the pitch of the conductor helix being shown out-of-scale for clarification in the drawings;

FIG. 2 schematically illustrates a slag bath generator having a safety facility according to the invention in the form of a first set of conductors which extend helically and parallel to one another and a second set of conductors which extend to the opposite hand and which are provided in the same number as the first set, the drawing showing merely two individual conductors wound to opposite hands for purposes of illustration; and FIG. 3 is a view on an enlarged scale showing the wall construction of a slag bath generator according to the invention.

With reference now to the drawings, and particularly to FIG. 1, there is shown in general outline a slag bath generator of the type described in U.S. Pat. No. 4,013,427, assigned to the Assignee of the present application. Reference numeral I identifies a gasification zone above a slag bath and below a circumferential constriction 18 in the slag bath generator. Reference numeral II identifies a final gasification zone which lies above the circumferential constriction 18 and extends vertically to the top of the generator. Nozzles 2 and 3 are employed to introduce fine-grained fuel and a gasification medium into the slag bath generator. The fuel, for example, can be finely-divided coal. Oxygen is the preferred gasification medium but steam and recycled gas may also be employed for this purpose. At the bottom of the slag bath generator 1 is a slag overflow 10.

As best shown in FIG. 3, the wall of the slag bath generator shown in FIG. 1 comprises an outer metal casing 11 on which a layer 12 of ceramic insulating material is disposed. Electrical conductors 13 are disposed within the ceramic layer 12 for the purpose of detecting faults or ruptures in cooling pipes 14 which, as shown in FIG. 1, extend from a ring main 15 at the top of the generator to a ring main 16 at the lower end of the generator. The ring mains, in turn, are connected through a conduit 4 to a circulating pump 5 which continuously circulates water or other coolant through the tubes 14. An accumulator 6 is connected to the conduit 4 as shown. Suitable cooling means may be inserted into the closed circulation system if desired. The vertical tubes 14 are ordinarily arranged in groups and are interconnected by vertical webs welded to adjacent tubes.

With reference again to FIG. 3, it will be seen that on the side of the tubes which is closest to the gasification chamber, there is an accumulation 17 of condensed particles of slag which build-up in the course of operation of the slag bath generator and which provide heat protection for the cooling tubes 14.

In the embodiment of the invention shown in FIG. 1, a single conductor 13 extends helically around the group of cooling tubes. The opposite ends of the conductor 13 are connected through a source of potential, such as battery 7, to a meter 8 or other indicating device, the arrangement being such that in the event of a rupture or other fault in a cooling tube 14 and resultant melting of the ceramic insulating material 12, the conductor 13 will melt, thereby breaking the electrical circuit with source 7 and meter 8. This, of course, will be indicated on the meter 8, signaling the operator that a fault in a cooling tube has occurred before the ceramic material 12 completely melts.

In FIG. 1, for purposes of simplicity, the pitch of the conductor 13 is shown greatly exaggerated. The pitch of the conductor 13 should be in the range of 1 to 5 centimeters, and preferably 2 centimeters to give detection of adequate accuracy over the entire surface area of the cooling tubes 14. Preferably, the conductor 13 is disposed at a distance of from 5 to 20 millimeters away from the outer wall of the cooling tube group (i.e., a circumferentially-arranged group of tubes). The conductor can be wound directly on the cooling tube group with the interposition of an insulating intermediate layer. If desired, the conductors can be placed in foils. Conveniently, copper-enameled or aluminum-enameled conductors can be used. Metal alloys having melting points of from 500° C. to 1000° C. can be used for the conductors.

In FIG. 2, elements corresponding to those of FIG. 1 are identified by like reference numerals. In this case, however, there are two conductors 13 and **13*a* wound helically about the group of tubes 14, but wound with opposite pitches. Again, the pitch of the conductors 13 and 13*a* is greatly exaggerated in FIG. 2 and will normally be in the range of 1 to 5 centimeters such that, since the two conductors 13 and 13*a* are wound in opposite directions, the two conductors cross one another at many places over the height and periphery of the group of cooling tubes. The two conductors 13 and 13*a*** can be connected to separate indicating circuits or the same indicating circuit.

It will be appreciated that a number of separate conductors arranged about the cooling tubes 14 in zones can be connected to separate energizing and detecting circuits so that the location of a fault can be determined. For example, a series of helically-wound, separate conductors can be disposed one above the other around the tubes 14 such that the height of a fault can be determined. Furthermore, helically-wound conductors can be used in combination with vertically-extending conductors arranged in zones and connected to separate detecting circuits so that not only the approximate height of the fault can be detected but also its circumferential position about the slag bath generator.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. In a high-temperature pressure vessel of the type in which cooling tubes normally covered by a layer of slag extend around a combustion chamber having a liquid slag bath at the bottom thereof while disposed within a metal casing and in which a ceramic lining of heat insulating material is disposed between said cooling tubes and the metal casing, the improvement of means for detecting a fault in a cooling tube and resultant localized heating, said detecting means comprising at least one electrical conductor embedded in said insulating material adjacent the cooling tubes on the side thereof opposite the combustion chamber, said electrical conductor comprises a wire selected from the group consisting of copper-enameled wire and aluminum-enameled wire having a melting point of at least 500° C., and means external to the vessel for detecting an interruption in current flow through the conductor, thereby indicating a fault in a tube and resultant heating and melting of the conductor before complete melting of said ceramic lining of heat insulating material.

2. The improvement of claim 1 in which said electrical conductor is disposed at a distance of from 5 to 20 millimeters away from the wall defined by the radially-outwardly extending sides of the cooling tubes.

3. The improvement of claim 1 wherein the conductor is placed within foil.

4. The improvement of claim 1 wherein said detecting means includes two electrical conductors wound helically about said cooling tubes, the pitch of the helically-wound conductors being opposite each other.

5. In a high-temperature pressure vessel of the type in which cooling tubes extend around a combustion chamber disposed within a metal casing and in which heat insulating material is disposed between said cooling tubes and the metal casing, the improvement of means for detecting a fault in a cooling tube and resultant localized heating, said detecting means comprising a plurality of electrical conductors having a melting point of at least 500° C. embedded in said insulating material adjacent the cooling tubes on the side thereof opposite the combustion chamber, at least one of said conductors being helically wound around said cooling tubes, said electrical conductors further including a plurality of vertically-extending conductors embedded in said insulating material and arranged in zones around the periphery of the pressure vessel, and means external to the vessel for detecting an interruption in current flow through the conductor, thereby indicating a fault in a tube and resultant heating and melting of the conductor, said means including a circuit external to the vessel for detecting an interruption in current flow through said helical conductor, said vertically-extending conductors being connected to separate detecting circuits such that the approximate height of a fault and its circumferential position about the pressure vessel can be determined from a consideration of those detecting circuits through which current is not flowing.

* * * * *